US009433970B2

(12) United States Patent
Lee et al.

(10) Patent No.: US 9,433,970 B2
(45) Date of Patent: Sep. 6, 2016

(54) REINFORCEMENT LIQUID JET DEVICE AND METHOD OF MANUFACTURING DISPLAY PANEL

(71) Applicants: Hyun-Woo Lee, Yongin (KR); Yong-Ok Kwon, Yongin (KR); Jae-Gu Han, Yongin (KR); Yeong-Seok Jeong, Yongin (KR)

(72) Inventors: Hyun-Woo Lee, Yongin (KR); Yong-Ok Kwon, Yongin (KR); Jae-Gu Han, Yongin (KR); Yeong-Seok Jeong, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 400 days.

(21) Appl. No.: 13/922,326

(22) Filed: Jun. 20, 2013

(65) Prior Publication Data

US 2014/0037848 A1 Feb. 6, 2014

(30) Foreign Application Priority Data

Aug. 6, 2012 (KR) ..... 10-2012-0085999

(51) Int. Cl.

| | |
|---|---|
| ***B05D 1/32*** | (2006.01) |
| ***B05B 1/30*** | (2006.01) |
| ***B05B 13/02*** | (2006.01) |
| ***B05B 13/04*** | (2006.01) |
| ***B05B 15/04*** | (2006.01) |

(52) U.S. Cl.

CPC ..... *B05D 1/32* (2013.01); *B05B 1/3046* (2013.01); *B05B 13/0292* (2013.01); *B05B 13/04* (2013.01); *B05B 15/045* (2013.01); *B05B 15/0406* (2013.01); *B05B 15/0443* (2013.01)

(58) Field of Classification Search

USPC ..... 427/256, 282; 118/301

See application file for complete search history.

(56) References Cited

U.S. PATENT DOCUMENTS

| | | | | |
|---|---|---|---|---|
| 8,985,172 | B2 * | 3/2015 | Wang | G02F 1/1303 118/301 |
| 2004/0081759 | A1 * | 4/2004 | Maruyama | B05C 5/0216 427/256 |
| 2005/0115499 | A1 * | 6/2005 | Lee | G02F 1/1339 118/642 |
| 2009/0213317 | A1 * | 8/2009 | Jian | G02F 1/1341 349/163 |
| 2010/0246163 | A1 * | 9/2010 | Chen | G02B 6/0088 362/97.1 |

FOREIGN PATENT DOCUMENTS

| | | | |
|---|---|---|---|
| JP | 2003-084296 | B2 | 4/2011 |
| KR | 10-2001-0046455 | A | 6/2001 |
| KR | 10-2005-0064920 | A | 6/2005 |
| KR | 10-2008-0002129 | A | 1/2008 |
| KR | 10-2010-0054623 | A | 5/2010 |

* cited by examiner

*Primary Examiner* — Cachet Sellman
(74) *Attorney, Agent, or Firm* — Lee & Morse, P.C.

(57) ABSTRACT

A reinforcement liquid jet device includes a nozzle unit that is spaced apart from a display panel by a predetermined interval and that jets a reinforcement liquid to a side of the display panel, a moving frame that is movably installed and the nozzle unit is coupled to the moving frame, a mask unit that is rotatably coupled to the moving frame, and a driving unit that is coupled to the moving frame and that rotates the mask unit.

7 Claims, 4 Drawing Sheets

REINFORCEMENT LIQUID JET DEVICE AND METHOD OF MANUFACTURING DISPLAY PANEL

CROSS-REFERENCE TO RELATED PATENT APPLICATION

This application claims priority under 35 U.S.C. §119 to Korean Patent Application No. 10-2012-0085999, filed on Aug. 6, 2012, in the Korean Intellectual Property Office, the disclosure of which is incorporated herein in its entirety by reference.

BACKGROUND OF THE INVENTION

Display panels are used for providing visual information, such as images or pictures, to users. The display panels are manufactured in various forms to represent the visual information, such as images or pictures.

SUMMARY OF THE INVENTION

Embodiments may be realized by providing a reinforcement liquid jet device that includes a nozzle unit that is disposed spaced apart from a display panel by a predetermined interval and jets the reinforcement liquid to the side of the display panel, a moving frame that is movably installed in an external frame and in which the nozzle unit is installed, a mask unit that is rotatably installed in the moving frame, and a driving unit that is installed in the moving frame and rotates the mask unit.

The mask unit may include a rotation unit that is rotatably installed in the moving frame, and a liquid splash prevention unit that is formed bending from the rotation unit. The length of the rotation unit may be equal to or greater than a length from the center of rotation of the rotation unit to an end of the nozzle unit.

The height of the liquid splash prevention unit may be formed to be larger than a space between the display panel and the nozzle unit. The mask unit may include a plurality of mask units, the plurality of mask units may be disposed to be spaced apart from each other by a predetermined interval, and the display panel and the nozzle unit may be disposed between the plurality of mask units during the rotation of the plurality of mask units.

The reinforcement liquid jet device may further include a vision unit that is disposed spaced apart from the nozzle unit by a predetermined interval and that moves in the same speed as the nozzle unit during the movement of the nozzle unit. The vision unit may include a first fixed frame that is installed in the moving frame, and a light emitting unit that is installed at an end of the first fixed frame.

The reinforcement liquid jet device may further include a cleansing unit that is installed in the moving frame. The cleansing unit may include a fixing unit that is installed in the moving frame, and a contact unit that is installed in the fixing unit and contacts one side of the mask unit. The fixing unit may include a second fixed frame that is installed to be fixed to the moving frame, and a rotation frame that is rotatably installed on the second fixed frame and has an external surface on which the contact unit is installed.

The reinforcement liquid jet device may further include a supporting unit that is rotatably installed in the external frame and supports the display panel. The supporting unit may include a rotation shaft that is rotatably installed in the external frame, a rotation driving unit that is installed in the external frame and rotates the rotation shaft, and an adsorption unit that is coupled to the rotation shaft and adsorbs the display panel.

Embodiments may also be realized by providing a method of manufacturing a display panel, the method including disposing the display panel to have a predetermined angle with respect to the ground by placing the display unit in a supporting unit and then operating the supporting unit, disposing a nozzle unit to be spaced apart from the side of the display panel by a predetermined interval by moving a moving frame, disposing the nozzle unit and a portion of the display panel at the side of a mask unit, which is installed in the moving frame, by rotating the mask unit, and spouting a reinforcement liquid through the nozzle unit while moving the moving frame.

In the spouting of the reinforcement liquid, the moving frame may move in a direction of the length of the display panel. The spouting of the reinforcement liquid may include jetting a visible ray to a portion of the display panel through a vision unit that is installed in the moving frame.

The mask unit may include a rotation unit that is rotatably installed in the moving frame, and a liquid splash prevention unit that is formed bending from the rotation unit. The length of the rotation unit may be equal to or greater than a length from the center of rotation of the rotation unit to an end of the nozzle unit.

The method may further include cleaning the mask unit through a cleansing unit, which is installed in the moving frame, by rotating the mask unit. A portion of the mask unit may contact the cleansing unit, and thus, the mask unit may be cleaned.

BRIEF DESCRIPTION OF THE DRAWINGS

Features will become more apparent by describing in detail exemplary embodiments thereof with reference to the attached drawings in which.

DETAILED DESCRIPTION OF THE INVENTION

Hereinafter, embodiments will be described more fully with reference to the accompanying drawings, in which exemplary embodiments of the invention are shown. The embodiments may, however, be embodied in many different forms and should not be construed as limited to the exemplary embodiments set forth herein. Rather, these embodiments are provided so that this disclosure will be thorough and complete, and will fully convey the scope of exemplary implementations to those of ordinary skilled in the art.

The terminology used herein is for the purpose of describing particular embodiments only and is not intended to be limiting. As used herein, the singular forms 'a', 'an', and 'the' are intended to include the plural forms as well, unless the context clearly indicates otherwise. It will be further understood that the terms "comprises' and/or 'comprising,' when used in this specification, specify the presence of stated features, integers, operations, elements, and/or components, but do not preclude the presence or addition of one or more other features, integers, operations, elements, components, and/or groups thereof.

It will be understood that, although the terms 'first', 'second', 'third', etc., may be used herein to describe various elements, components, regions, layers and/or sections, these elements, components, regions, layers and/or sections should not be limited by these terms. These terms are only used to distinguish one element, component, region, layer or section from another region, layer or section. Expressions such as "at least one of," when preceding a list of elements, modify the entire list of elements and do not modify the individual elements of the list.

Figure 1:
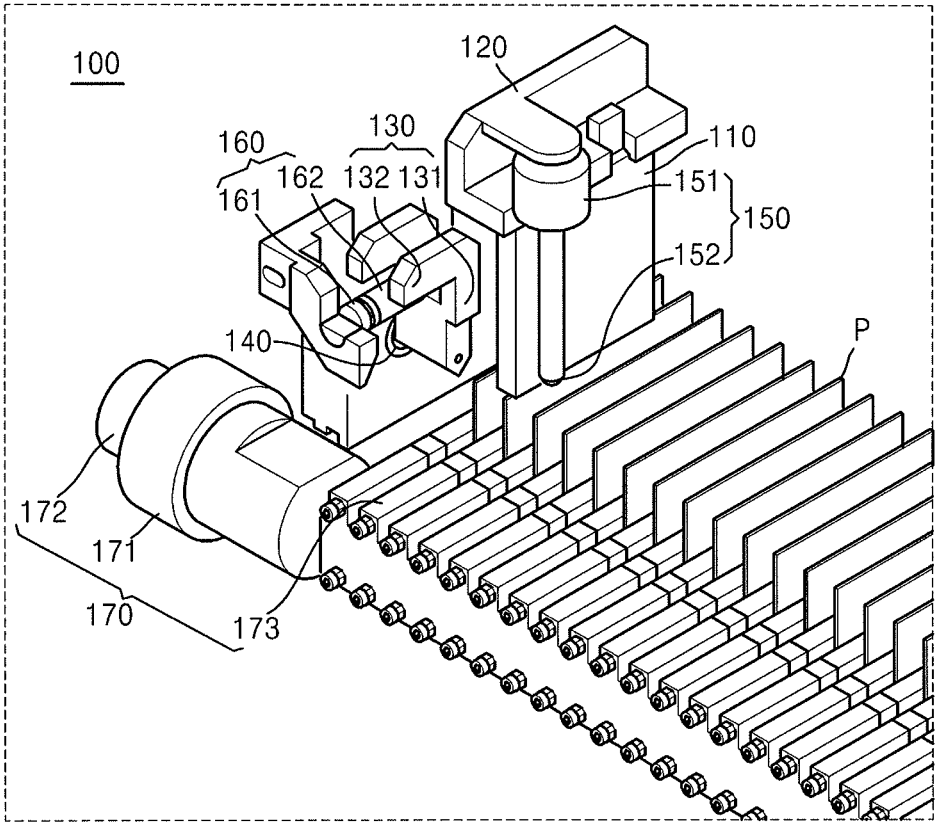
FIG. 1 is a perspective view illustrating a reinforcement liquid jet device, according to an exemplary embodiment.
Figure 2:
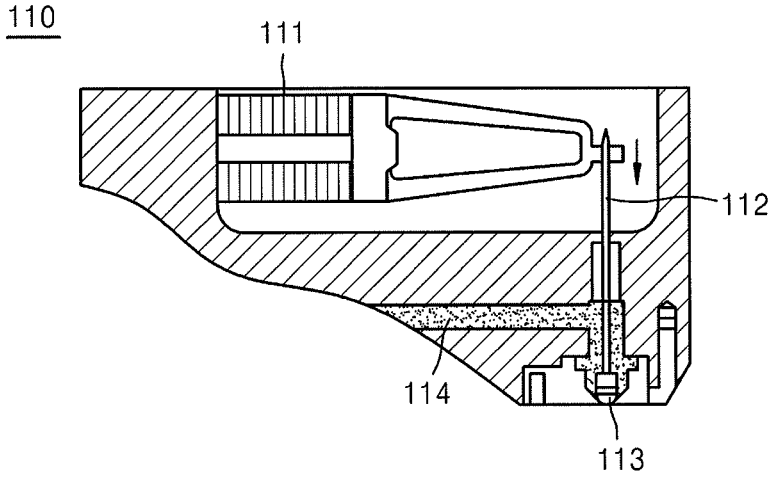
FIG. 2 is a conceptual diagram illustrating a nozzle unit illustrated in FIG. 1.
Figure 3:
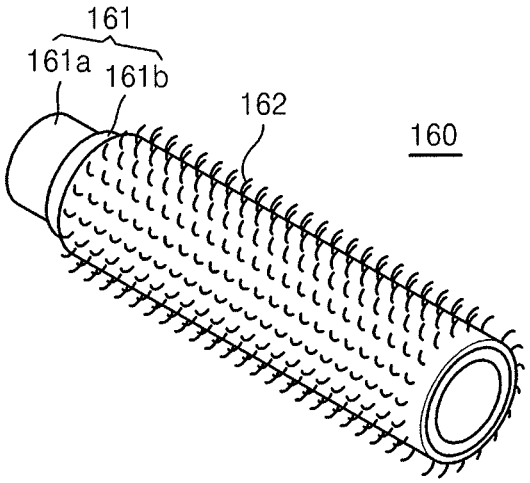
FIG. 3 is a perspective view illustrating a cleansing unit illustrated in FIG. 1.

FIG. 1 is a perspective view illustrating a device 100 for jetting a reinforcement liquid (that is, a reinforcement liquid jet device), according to an exemplary embodiment. FIG. 2 is a conceptual diagram illustrating a nozzle unit 110 illustrated in FIG. 1. FIG. 3 is a perspective view illustrating a cleansing unit 160 illustrated in FIG. 1.

Referring to FIGS. 1 through 3, the reinforcement liquid jet device 100 may include the nozzle unit 110, a moving frame 120, a mask unit 130, a driving unit 140, a vision unit 150, the cleansing unit 160, and a supporting unit 170. The supporting unit 170 may hold a plurality of display panels P therein, e.g., the display panels may be standing on sides thereof with opposing sides thereof facing the nozzle unit 110.

In detail, the nozzle unit 110 is disposed spaced apart from a display panel P by a predetermined interval. The nozzle unit 110 may jet the reinforcement liquid to the side of the display panel P. The reinforcement liquid may be formed of a material, such as acrylic urethane or the like. In addition, the nozzle unit 110 may jet a predetermined amount of the reinforcement liquid to the side of the display panel P.

In particular, the nozzle unit 110 may include a piezo actuator 111 that generates a driving power through current, and a shaft 112 that moves in a straight line by the piezo actuator 111. In addition, the nozzle unit 110 may further include a sealing ball 113 that is formed at one end of the shaft 112. The sealing ball 113 opens and closes a fluid path 114 according to the movement of the shaft 112.

In this case, in the nozzle unit 110, the shaft 112 may be moved in the straight line by the driving of the piezo actuator 111, and the sealing ball 113 may open the fluid path 114 according to the straight movement of the shaft 112, thereby spouting the reinforcement liquid to the outside. In particular, the piezo actuator 111 may adjust the amount of the reinforcement liquid, which is spouted to the outside, by being turned on or off during a predetermined time interval.

The moving frame 120 may be movably installed in an external frame (not shown), and the nozzle unit 110 may be installed therein. For example, the moving frame 120 may be coupled to the external frame and the nozzle unit 110 may be coupled to the moving frame 120. The moving frame 120 may be formed in a plate form, and the external frame may be linearly moved by an external driving unit (not shown).

The mask unit 130 may be rotatably installed in the moving frame 120. In this case, the mask unit 130 may include a rotation unit 131 that is rotatably installed in the moving frame 120. For example, the rotation unit 131 may be coupled to, e.g., directly coupled to, the moving frame 120 in a manner that allows rotation of the rotation unit 131 with respect to the moving frame 120. In addition, the moving frame 120 may include a liquid splash prevention unit 132 that is formed bent from the rotation unit 131. Accordingly, the prevention unit 132 may be rotatable with the rotation unit 131.

The rotation unit 131 and the liquid splash prevention unit 132 may form a predetermined angle. For example, the rotation unit 131 and the liquid splash prevention unit 132 may form a right angle. Alternatively, the rotation unit 131 and the liquid splash prevention unit 132 may form an acute angle or an obtuse angle.

In addition, an end of the rotation unit 131 may be formed in a side that is lower than one end of the nozzle unit 110. In detail, the length of the rotation unit 131 may be equal to or greater than a length measured from a center of rotation of the rotation unit 131 to an end of the nozzle unit 110.

The height of the liquid splash prevention unit 132 may be formed to be larger than a space between the display panel P and the nozzle unit 110. For example, the liquid splash prevention unit 132 may be disposed parallel to the display panel P and the nozzle unit 110, and may be formed to be overlapped with a portion of the display panel P and a portion of the nozzle unit 110.

The mask unit 130 may include a plurality of mask units. In this case, the plurality of mask units may be disposed to be spaced apart from each other by a predetermined interval. In addition, the display panel P and the nozzle unit 110 may be disposed between the plurality of mask units during the rotation of the plurality of mask units. In detail, the interval between the plurality of masks may be formed to be larger than a width of at least one of the display panel P and the nozzle 110.

The driving unit 140 may be formed so as to be in and/or coupled to the moving frame 120. The driving unit 140 may be formed in various forms to effectuate movement. For example, the driving unit 140 may include a motor that is connected to the mask unit 130, and thus providing a driving power to rotate the mask unit 130. The driving unit 140 may include an air pressure rotation cylinder that is connected to the mask unit 130, and thus generating a driving power to rotate the mask unit 130. The driving unit 140 may include a fluid pressure rotation cylinder that operates by using a fluid pressure instead of an air pressure.

However, for convenience of description, the case in which the driving unit 140 includes the air pressure rotation cylinder is described in detail below.

The vision unit 150 may be disposed spaced apart from the nozzle unit 110 by a predetermined interval. In this case, the vision unit 150 may move in the same speed as the nozzle unit 110 during the movement of the nozzle unit 110. In particular, the vision unit 150 may be installed to be connected to the moving frame 120. The vision unit 150 may be movably installed in the external frame instead of being installed in the moving frame 120. However, for convenience of description, the case in which the vision unit 150 is installed in the moving frame 120 is described in detail below.

The vision unit 150 may include a first fixed frame 151 that is installed in the moving frame 120. In addition, the vision unit 150 may include a light emitting unit 152 that is installed at an end of the first fixed frame 151. The light emitting unit 152 may include a lamp that emits light to the outside.

The cleansing unit 160 may be installed in the moving frame 120. In this case, the cleansing unit 160 may be installed to be fixed to the moving frame 120. In addition, the cleansing unit 160 may be installed to contact the mask unit 130 when the mask unit 130 rotates.

For example, the cleansing unit 160 may be installed to contact the side of the mask unit 130, e.g., so as to the clean the liquid splash prevention unit 132. In particular, in the case where the mask unit 130 includes a plurality of mask units as described above, the width of the cleansing unit 160 may be formed to be similar to a space between the plurality of mask units 130.

The cleansing unit 160 may include a fixing unit 161 that is installed in the moving frame 120, and a contact unit 162 that is installed on the fixing unit 161 and is movable to contact sides of the mask unit 130. The contact unit 162 may be formed of a material having a nonwoven fabric form. The contact unit 162 may include therein projections that assist in cleaning the masking unit 130. The projections may be a part of the nonwoven fabric material or may be extensions thereof.

The fixing unit 161 may include a second fixed frame 161*a* that is installed to be fixed to the moving frame 120. In addition, the fixing unit 161 may further include a rotation frame 161*b* that is rotatably installed on the second fixed frame 161*a* and has an external surface on which the contact unit 162 is installed thereto. For example, the rotation frame 161*b* may rotate with respect to the second fixed frame 161*a*.

In this case, a space is formed in the inside of the rotation frame 161*b*, and the second fixed frame 161*a* may be inserted into the space. In addition, the rotation frame 161*b* may be formed in a cylindrical from. In particular, when the rotation frame 161*b* is installed on the second fixed frame 161*a*, a bearing may be installed between the rotation frame 161*b* and the second fixed frame 161*a*.

The cleansing unit 160 is not limited to the above, and may include a device for cleaning the mask unit 130 by jetting air or fluid. However, for convenience of description, the case in which the cleansing unit 160 includes the fixing unit 161 and the contact unit 162 is described in detail below.

The supporting unit 170 may be rotatably installed in the external frame. In this case, the supporting unit 170 may be formed so that one end thereof supports the display panel P. In detail, the supporting unit 170 may include a rotation shaft 171 that is rotatably installed in the external frame. The supporting unit 170 may further include a rotation driving unit 172 that is installed in the external frame and that rotates the rotation shaft 171. In addition, the supporting unit 170 may further include an adsorption unit 173 that is coupled to the rotation shaft 171 and that holds the display panel P.

The rotation driving unit 172 may include at least one of, e.g., a motor, an air pressure rotation cylinder, and a fluid pressure rotation cylinder. The adsorption unit 173 may hold the display panel P by adsorbing the display panel P via forming a vacuum.

The supporting unit 170 is not limited to the above, and may include any device that is rotatably installed in the external frame and supports the display panel P. In detail, the supporting unit 170 may include a device that supports the display panel P through a separate link structure.

However, for convenience of description, the case in which the supporting unit 170 includes the rotation shaft 171, the rotation driving unit 172, and the adsorption unit 173 is described in detail below.

Below, a method of manufacturing the display panel P through the reinforcement liquid jet device 100 is described in detail.

Figure 4:
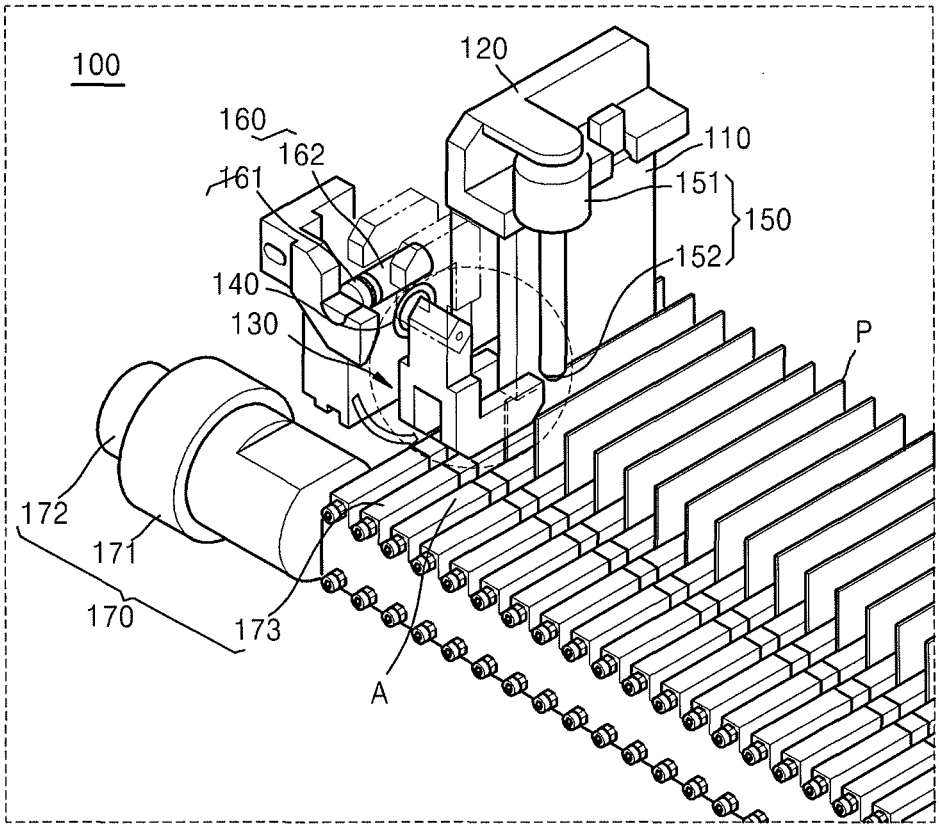
FIG. 4 is a diagram showing an operational state of the reinforcement liquid jet device illustrated in FIG. 1.
Figure 5:
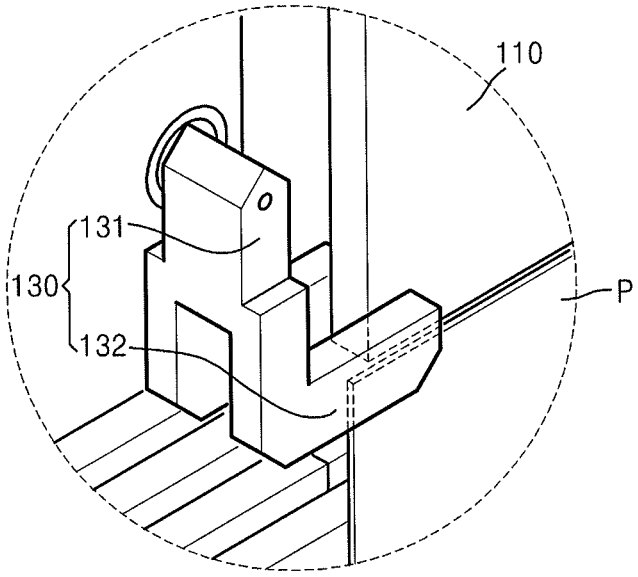
FIG. 5 is a diagram showing a magnification of a portion A of FIG. 4.
Figure 6:
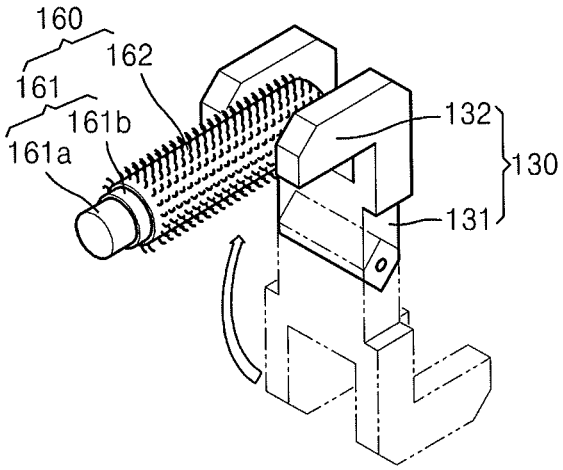
FIG. 6 is a diagram showing operational states of the cleansing unit and mask unit illustrated in FIG. 4.

FIG. 4 is a diagram showing an operational state of the reinforcement liquid jet device 100 illustrated in FIG. 1. FIG. 5 is a diagram showing a magnification of a portion A of FIG. 4. FIG. 6 is a diagram showing operational states of the cleansing unit 160 and mask unit 130, illustrated in FIG. 4.

Referring to FIGS. 4 through 6, first, the display panel P may include a liquid crystal display panel, an organic light emitting display panel, or the like.

After preparing the display panel P, the display panel P may be placed in the supporting unit 170. The rotation shaft 171 may be rotated by operating the rotation driving unit 172.

In this case, while the rotation shaft 171 rotates, the adsorption unit 173 may be disposed parallel to a lower side of the external frame. When the adsorption unit 173 is disposed like this, the display panel P may be placed in the adsorption unit 173. In particular, the display panel P may be disposed parallel to the ground by being placed in the adsorption unit 173.

When the display panel P is placed as described above, a portion of the adsorption unit 173 may be maintained in a vacuum state. In this case, the display panel P may be adsorbed on the portion of the adsorption unit 173, which is in the vacuum state, and then may be fixed to the adsorption unit 173.

When the above process is completed, the rotation shaft 171 may be rotated by operating the rotation driving unit 172. In this case, the adsorption unit 173 may be rotated according to the rotation of the rotation shaft 171, and the display panel P may form a predetermined angle with respect to the ground. In particular, the display panel P may be disposed perpendicular to the ground according to the rotation of the adsorption unit 173.

When the disposition of the display panel P is completed, the nozzle unit 110 may be spaced apart from the side of the display panel P by a predetermined interval while moving the moving frame 120. In this case, the nozzle unit 110 may be automatically disposed in a start position by sensing the handling of an operator or the position of the display panel P.

The mask unit 130 may be rotated while the operation is performed or after the operation is completed, as described above. In this case, the driving unit 140 may operate to rotate the mask unit 130.

The mask unit 130 rotates, and thus, the nozzle unit 110 and a portion of the display panel P may be disposed at the side of the mask unit 130. In particular, in the case where the mask unit 130 includes a plurality of mask units, a portion of the nozzle unit 110 and a portion of the display panel P may be disposed between the plurality of mask units.

In the case of the above disposition, the rotation unit 131 may be disposed parallel to one side of the nozzle unit 110. The liquid splash prevention unit 132 may be disposed to surround a space between the nozzle unit 110 and the display panel P. In particular, since the length of the rotation unit 131 and the height of the liquid splash prevention unit 132 is formed as described above, the liquid splash prevention unit 132 may be disposed to surround a space between the nozzle unit 110 and the display panel P.

When the disposition of the mask unit 130 is completed as described above, the reinforcement liquid may be spouted to the side of the display panel P through the nozzle unit 110 while moving the moving frame 120. In this case, the moving frame 120 may move in a direction of the length of the display panel P.

In the case where the nozzle unit 110 operates as described above, the piezo actuator 111 is operated and may move the shaft 112 in the straight line, and the sealing ball 113 may open the fluid path 114, thereby spouting the reinforcement liquid to the outside. In particular, an air pressure may be applied to the fluid path 114 to apply a force to the reinforcement liquid (refer to FIG. 2).

When the nozzle unit 110 spouts the reinforcement liquid, the vision unit 150 may jet a visible ray to a portion of the display panel P. In detail, the first fixed frame 151 may move together with the moving frame 120 at the same time when the light emitting unit 152 emits light.

When the nozzle unit 110 spouts the reinforcement liquid, the reinforcement liquid may be dripped on the side of the display panel P. In this case, when the operation of the nozzle unit 110 is stopped, a portion of the reinforcement liquid moves to the display panel P and another portion of the reinforcement liquid moves to the nozzle unit 110.

However, another portion of the reinforcement liquid may not move to the nozzle unit 110 or the display panel P and may be dripped in the air. The portion of the reinforcement liquid, which is dripped in the air, may move in the air due to a factor, such as temperature difference, pressure difference, or the like.

Further, the moving reinforcement liquid may contact the side of the mask unit 130 and may be adsorbed in the mask unit 130. For example, the moving reinforcement liquid may be removed by moving the liquid splash prevention unit 132 toward the cleaning unit 160 and then removing the reinforcement liquid from the liquid splash prevention unit 132 through a cleaning operation performed on the mask unit 130.

After the above operations are completed, the mask unit 130 may rotate again and may return to its original state, e.g., so as to be adjacent to the display panels P. In detail, when the driving unit 140 operates, the rotation unit 131 is rotated, and may rotate the liquid splash prevention unit 132 and may return the liquid splash prevention unit 132 to its original state.

While the above cleaning operations are performed, the mask unit 130 may contact the cleansing unit 160, and thus, the reinforcement liquid adsorbed in the mask unit 130 may be removed. For example, when the rotation unit 131 and the liquid splash prevention unit 132 rotates while the driving unit 140 operates, a portion of the rotation unit 131 and the liquid splash prevention unit 132 may contact the contact unit 162 so as to be cleaned by the cleansing unit 160.

In the case where the portion of the rotation unit 131 and/or the liquid splash prevention unit 132 contact the contact unit 162, the contact unit 162 may rotate on the second fixed frame 161*a* together with the rotation frame 161*b*. As the contact unit 162 rotates, the reinforcement liquid, adsorbed in the portion of the rotation unit 131 and the liquid splash prevention unit 132, may be removed. For example, the mask unit 130 may be cleaned by the nonwoven fabric material that forms an outer side of the contact unit 162.

When the above series of operations are completed, the moving frame 120 may move to another display panel P adjacent to the display panel P of which an operation has been completed. In this case, the moving frame 120 may repeatedly perform the above processes while moving in a direction opposite to the above processes so as to perform the operation on each of the plurality of display panels P arranged in the supporting unit 170.

Accordingly, the reinforcement liquid jet device 100 and the method of manufacturing a display panel may reduce the possibility of and/or prevent a contamination of the display panel P by preventing reinforcement liquid from adhering to the surface of the display panel P during the manufacturing of the display panel P. Accordingly, reliability of the display panel P may be secured. In addition, the reinforcement liquid jet device 100 and the method of manufacturing a display panel may reduce the possibility of and/or prevent a liquid splash phenomenon of the reinforcement liquid through a simple structure, and thus may secure a fast manufacturing process.

By way of summation and review, a display panel may include a plurality of substrates and a light emitting unit or may include a plurality of substrate and a liquid crystal unit. In this case, the plurality of substrates may be joined to each other through an encapsulation process so as to protect the light emitting unit or the liquid crystal unit arranged therebetween. By coating a reinforcement material, e.g., after joining the plurality of substrates to each other through the encapsulation process, exfoliation may be prevented and/or the strength of the encapsulation may be improved.

However, since a process of coating the reinforcement material may be performed in an open environment, a portion of the reinforcement material may be leaked in the air. In this case, a reinforcement material leaked in the air may adhere to other surfaces including, e.g., the surfaces of display panels, the surfaces of substrates, etc. Accordingly, a defective rate of the display panels may be increased and salability thereof may be degraded.

Embodiments relate to a reinforcement liquid jet device for manufacturing a display panel and a method of manufacturing the display panel, which display panel may have increased reliability and/or salability. For example, embodiments relate to a reinforcement liquid jet device may reduce the possibility of and/or prevent a liquid splash phenomenon of a reinforcement liquid when jetting the reinforcement liquid (which is to be placed between an upper substrate and a lower substrate while manufacturing a display panel). Embodiments also relate to a method of manufacturing a display panel that may reduce the possibility of and/or prevent a liquid splash phenomenon of a reinforcement liquid when jetting the reinforcement liquid.

Embodiments have been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing a display panel, the method comprising:

disposing the display panel to have a predetermined angle with respect to the ground by placing the display unit in a supporting unit and then operating the supporting unit;

disposing a nozzle unit to be spaced apart from a side of the display panel by a predetermined interval by moving a moving frame;

disposing the nozzle unit and a portion of the display panel at a side of a mask unit, which mask unit is installed in the moving frame, by rotating the mask unit; and spouting a reinforcement liquid to the side of the display panel through the nozzle unit while moving the moving frame.

2. The method of claim 1, wherein during the spouting of the reinforcement liquid, the moving frame moves in a direction of a length of the display panel.

3. The method of claim 1, wherein spouting the reinforcement liquid includes jetting a visible ray to a portion of the display panel through a vision unit that is coupled to the moving frame.

4. The method of claim 1, wherein the mask unit includes:

a rotation unit that is rotatably coupled to the moving frame, and a liquid splash prevention unit that is bent from the rotation unit.

5. The method of claim 4, wherein a length of the rotation unit is equal to or greater than a distance from a center of rotation of the rotation unit to an end of the nozzle unit.

6. The method of claim 1, further comprising cleaning the mask unit through a cleansing unit, which cleansing unit is coupled to the moving frame, by rotating the mask unit.

7. The method of claim 6, wherein during the cleaning of the mask unit, a portion of the mask unit contacts the cleansing unit.

* * * * *